US009895884B2

(12) United States Patent
Miyajima

(10) Patent No.: US 9,895,884 B2
(45) Date of Patent: Feb. 20, 2018

(54) HEAD AND LIQUID EJECTING APPARATUS

(71) Applicant: Seiko Epson Corporation, Tokyo (JP)

(72) Inventor: Hiroki Miyajima, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/465,943

(22) Filed: Mar. 22, 2017

(65) Prior Publication Data

US 2017/0282558 A1 Oct. 5, 2017

(30) Foreign Application Priority Data

Mar. 29, 2016 (JP) ..... 2016-065749

(51) Int. Cl.

| | |
|---|---|
| ***B41J 2/14*** | (2006.01) |
| ***B41J 2/045*** | (2006.01) |
| ***B41J 2/17*** | (2006.01) |
| ***B41J 2/175*** | (2006.01) |

(52) U.S. Cl.

CPC ..... *B41J 2/14201* (2013.01); *B41J 2/04581* (2013.01); *B41J 2/1433* (2013.01); *B41J 2/1707* (2013.01); *B41J 2/17563* (2013.01); *B41J 2/175* (2013.01); *B41J 2002/14306* (2013.01)

(58) Field of Classification Search

CPC .. B41J 2/14201; B41J 2/17563; B41J 2/1433; B41J 2/04581; B41J 2/1707; B41J 2002/14306; B41J 2/175

See application file for complete search history.

(56) References Cited

U.S. PATENT DOCUMENTS

2005/0068385 A1* 3/2005 Nanjo ..... B41J 2/17513 347/85
2005/0151800 A1* 7/2005 Kono ..... B41J 2/175 347/85
2010/0253752 A1* 10/2010 Miyajima ..... B41J 2/17596 347/85
2015/0042726 A1* 2/2015 Enomoto ..... B41J 2/14201 347/68

(Continued)

FOREIGN PATENT DOCUMENTS

JP 2013-039762 A 2/2013
JP 2015-033838 A 2/2015

(Continued)

*Primary Examiner* — Henok Legesse
(74) *Attorney, Agent, or Firm* — Harness, Dickey & Pierce, P.L.C.

(57) ABSTRACT

Nozzle rows that discharge the same liquids are disposed at locations symmetrical about a reference line. The flow path member includes a first flow path member, a second flow path member joined to the first flow path member, a filter retainer member that is joined to the second flow path member and that holds filters, a third flow path member that is joined to the filter retainer member. The liquid flow path includes first horizontal flow paths that are provided between the first flow path member and the second flow path member and that divide the liquid supplied from the liquid supply unit and buffer chambers provided on the first horizontal flow paths. Between the second flow path member and the filter retainer member, filter chambers are provided in regions that face the buffer chambers. The buffer chambers communicate with central portions of the filter chambers.

8 Claims, 10 Drawing Sheets

(56) References Cited

U.S. PATENT DOCUMENTS

| | | | | |
|---|---|---|---|---|
| 2015/0258786 | A1 | 9/2015 | Akahane et al. | |
| 2016/0059576 | A1 * | 3/2016 | Ito | B41J 2/17523 347/93 |

FOREIGN PATENT DOCUMENTS

| | | | |
|---|---|---|---|
| JP | 2015-077988 | A | 4/2015 |
| JP | 2015-174392 | A | 10/2015 |

* cited by examiner

HEAD AND LIQUID EJECTING APPARATUS

BACKGROUND

1. Technical Field

The present invention relates to a head and a liquid ejecting apparatus and, more particularly, to an ink jet type recording head and an ink jet type recording apparatus that ejects ink as a liquid.

2. Related Art

A piezo ink jet system is an on-demand type ink jet print system that discharges droplets of ink by deforming piezo elements through application of voltage (JIS Z8123-1:2013).

A permanent head (hereinafter, simply termed head) is a mechanical or electrical component of a printer main body which continually or intermittently produces liquid droplets of ink (JIS Z8123-1:2013).

A head for use in the piezo ink jet system includes a flow path formation substrate provided with a pressure generation chamber that communicates with a nozzle that ejects a liquid droplet, a piezo element provided on the side of one surface of the flow path formation substrate, and a drive circuit substrate joined to a piezo element side of the flow path formation substrate and provided with a drive circuit that drives the piezo element. The head ejects liquid droplets from the nozzle by causing pressure changes in the liquid within the pressure generation chamber.

For example, a known head includes a plurality of head bodies having rows of nozzles that discharge liquids and a flow path member for supplying the liquids to the head bodies from liquid storage units such as ink cartridges. Each head body is provided with nozzle rows in which nozzles that eject liquid droplets are aligned in a direction and which are aligned side by side in a direction that intersects that direction.

For example, in a head that has eight nozzle rows, the flow path member and the like are constructed so that, of the eight nozzle rows, each two nozzle rows disposed symmetrically about a center line of the eight nozzle rows, that is, a center line between the fourth and fifth rows, are supplied with the same one of four color inks; for example, the eight nozzle rows are supplied with yellow, cyan, magenta, black, black, magenta, cyan, and yellow inks in that order (see, e.g., JP-A-2013-039762). An ink jet type recording apparatus having such a head performs a recording operation while moving the head back and forth relative to a recording medium. Therefore, the order in which the color inks land on the ejection target medium remains the same between the back and forth movements.

In a known flow path member for supplying inks to a plurality of nozzle rows, flow paths through which the color inks supplied from ink cartridges storing the inks flow are each divided midway into branch flow paths (see, e.g., JP-A-2015-33838). This flow path member includes filters that remove undesired matters and gas bubbles from the inks supplied from the ink cartridges. The flow paths downstream of the filters are divided into branches so that each ink is supplied to corresponding two rows of the symmetrically disposed nozzle rows. In this manner, one kind of liquid or ink can be supplied to a plurality of nozzle rows.

However, in the flow path member provided with branched flow paths for various color inks, particularly in a construction in which the nozzle rows are symmetrically disposed separately for each color ink, the arrangement of the branch flow paths and filter chambers is complicated so that it is difficult or impossible to achieve space saving.

Furthermore, the head is subjected to a cleaning operation in which ink is sucked from nozzles so as to discharge gas bubbles and the like together with the ink from the flow paths downstream of a filter. In the foregoing flow path member, since the flow paths are branched downstream of the filters and are configured in accordance with the arrangement of the nozzle rows, the flow path length downstream of the filters is longer than the flow path length upstream of the filters. Therefore, in the cleaning operation, the amount of ink discharged from the flow paths downstream of the filters is large.

This problem is not limited to the heads that eject inks but similarly exists in heads that eject other kinds of liquids.

SUMMARY

An advantage of some aspects of the invention is that a head and a liquid ejecting apparatus that are capable of realizing high-quality ejection of liquid while making the configuration of branched flow paths as compact as possible are provided. Another advantage of some aspects of the invention is that a head and a liquid ejecting apparatus capable of reducing the amount of liquid discharged in the cleaning operation are provided.

In recording heads, a head capable of recording according to one aspect of the invention includes a head body that has nozzle rows in which nozzle openings that eject liquid are disposed side by side in a first direction and which are disposed side by side in a second direction that intersects the first direction, a liquid flow path that supplies the liquid from a liquid supply unit to the head body, and a flow path member that includes filters provided in the liquid flow path. The nozzle rows that discharge the same liquid are disposed at locations symmetrical about a reference line that extends in the first direction. The flow path member includes a first flow path member to which the liquid from the liquid supply unit is supplied, a second flow path member joined to the first flow path member, a filter retainer member that is joined to the second flow path member and that holds the filters, a third flow path member that is joined to the filter retainer member and that supplies the liquid to the head body. The liquid flow path includes an upstream flow path upstream of the filters and downstream flow paths that are downstream of the filters and that are formed separately for each nozzle row. The upstream flow path includes horizontal flow paths that are provided between the first flow path member and the second flow path member and that divide the liquid supplied from the liquid supply unit and buffer chambers provided on the horizontal flow paths branched so as to divide the liquid. Between the second flow path member and the filter retainer member, filter chambers are provided in regions that face the buffer chambers. The buffer chambers communicate with central portions of the filter chambers.

In this exemplary embodiment, an upstream portion to which the liquid supplied from the liquid supply unit flows connects to an intermediate portion of the horizontal flow path and the path is branched to two opposite sides in the horizontal flow path, equal and smooth branching can be achieved and, furthermore, the degree of freedom in laying out the branch flow paths can be improved and space saving can be facilitated. This also makes it possible to supply the liquid corresponding to the symmetrical arrangement of the nozzle rows and also to improve the ease in discharging gas bubbles during cleaning and reduce the amount of the liquid discharged for cleaning. Furthermore, even in a construction in which a plurality of liquid flow paths are each branched corresponding to the symmetrical arrangement of the nozzle rows, the pressure of the liquids supplied to the nozzle rows can be inhibited from varying among the nozzle rows. Due to this, a head capable of performing high-quality ejection of liquids can be provided.

In the foregoing head, each of the horizontal flow paths is a single flow path whose two end portions are provided with the buffer chambers and an intermediate portion of that flow path communicates with a flow path extending from the liquid supply unit so as to be a branching portion at which the flow path branches into two opposite horizontal directions.

This eliminates the stagnation of the liquid caused by the branching, so that space-saving and uniform branching can be achieved.

Furthermore, in the foregoing head, the branching portion may be immediately under the liquid supply unit.

This eliminates unnecessary flow paths and allows further space saving.

Furthermore, in the foregoing head, the branching portion may be provided in a straight portion of each horizontal flow path.

This allows smoother branching.

Another aspect of the invention is a liquid ejecting apparatus that includes a head as described above.

This aspect of the invention provides a liquid ejecting apparatus that allows the space saving of flow paths and that is capable of realizing high-quality ejection of liquids and reducing the amount of the liquids discharged during cleaning.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary Embodiment 1

An exemplary embodiment of the invention will be described in detail below. This exemplary embodiment of the invention will be described in conjunction with an ink jet type recording head (hereinafter, simply referred to as head) that ejects ink as an example of a permanent head.

Figure 1:
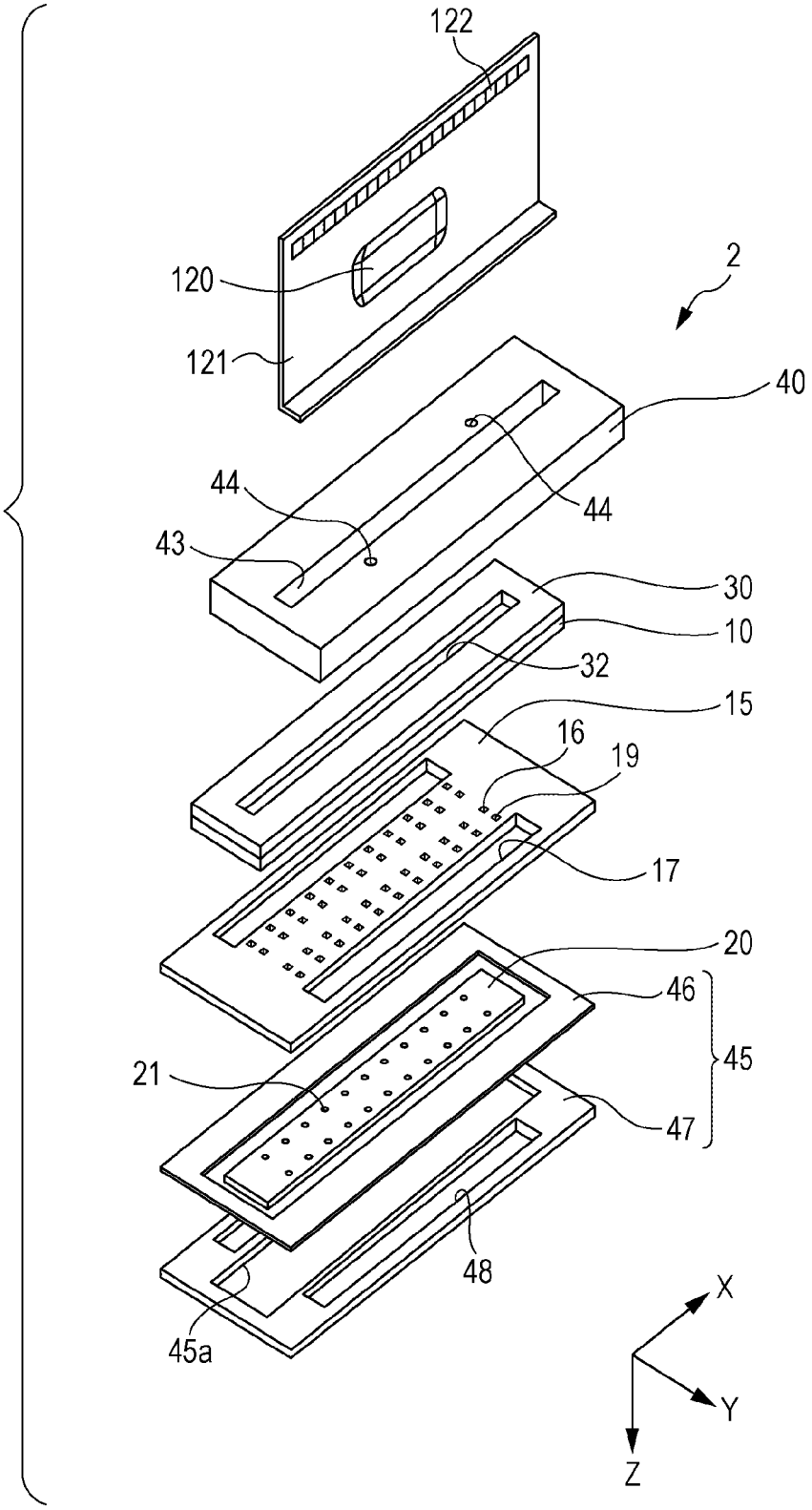
FIG. 1 is an exploded perspective view of a head body.
Figure 2:
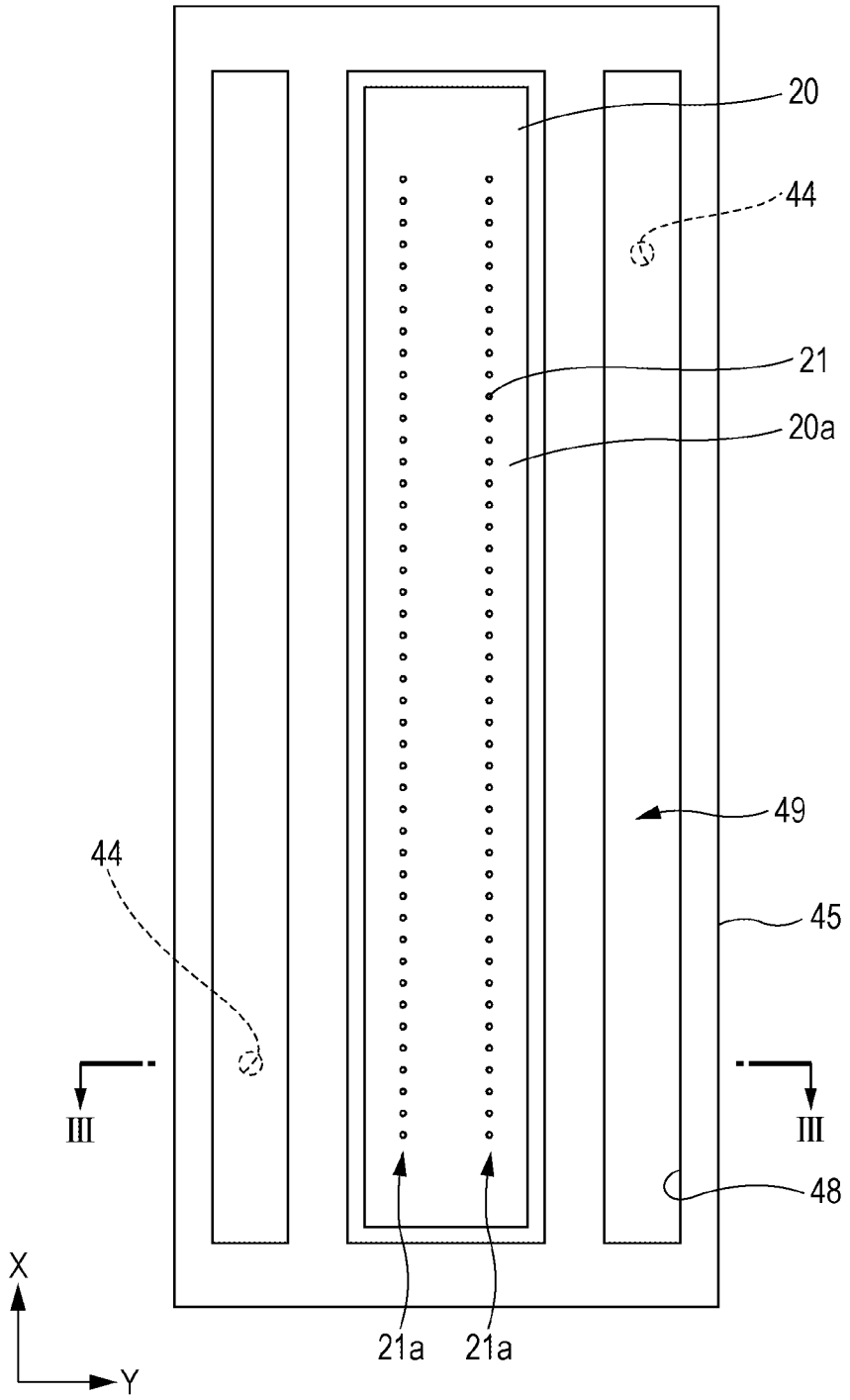
FIG. 2 is a plan view of the head body.
Figure 3:
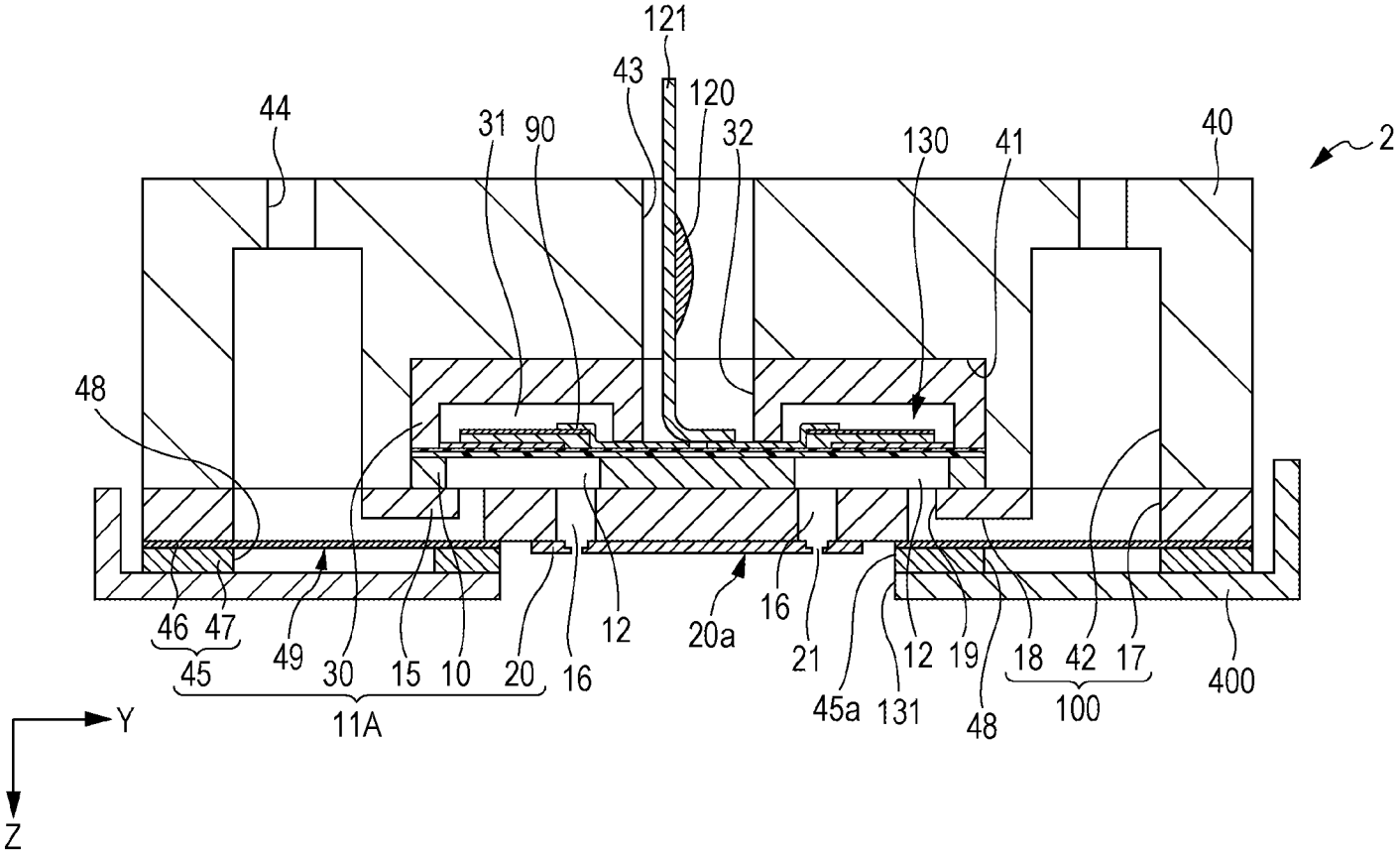
FIG. 3 is a sectional view taken on line III-III in FIG. 2.

First, an example of a head body provided in a head according to this exemplary embodiment will be described. FIG. 1 is an exploded perspective view of a head body. FIG. 2 is a plan view of the head body. FIG. 3 is a sectional view of the head body taken on line III-III in FIG. 2.

A head body 2 includes a plurality of members such as a flow path formation substrate 10, a communication plate 15, a nozzle plate 20, a protective substrate 30, a compliance substrate 45, a case member 40, and a wiring board 121.

The flow path formation substrate 10 may be made of a metal, such as stainless steel or nickel (Ni), a ceramic material represented by zirconium oxide ($ZrO_2$) or aluminum oxide ($Al_2O_3$), a glass ceramic material, an oxide such as magnesium oxide (MgO) or lanthanum aluminate ($LaAlO_3$), etc. In this exemplary embodiment, the flow path formation substrate 10 is made of a silicon single crystal substrate. In this flow path formation substrate 10, pressure generation chambers 12 compartmentalized by a plurality of partition walls are disposed side by side along a direction in which a plurality of nozzle openings 21 that discharge ink are aligned. These pressure generation chambers 12 are formed by performing anisotropic etching on the flow path formation substrate 10 from the side of one surface thereof.

Hereinafter, a direction in which the pressure generation chambers 12 are aligned side by side (that is also the direction in which the nozzle openings 21 are aligned) will be referred to as an alignment direction of the pressure generation chambers 12 or a first direction X. Furthermore, the flow path formation substrate 10 is provided with a plurality of rows of the pressure generation chambers 12 aligned side by side in the first direction X. In this exemplary embodiment, two rows of the pressure generation chambers 12 extend in the first direction X. A direction of the plurality of rows of the pressure generation chambers 12 are aligned side by side will be hereinafter referred to as a second direction Y. Furthermore, a direction that intersects the first direction X and the second direction Y will be referred to as an ejection direction of ink droplets (liquid droplets) or a third direction Z. The third direction is a direction in which a head body and a head substrate are stacked as mentioned in the appended claims. The coordinate axes indicated in the drawings represent the first direction X, the second direction Y, and the third direction Z. The directions indicated by the arrows are also termed the positive directions and the opposite directions are also termed the negative directions. Incidentally, although, in this exemplary embodiment, the directions X, Y and Z are orthogonal to each other, the invention is not limited to a construction in which the foregoing components are arranged in directions orthogonal to each other.

On the one-surface side (a third direction Z side, that is, a positive Z direction side) of the flow path formation substrate 10, the communication plate 15 and the nozzle plate 20 are stacked in the third direction Z. Specifically, the head body 2 includes the communication plate 15 provided on the one surface of the flow path formation substrate 10 and the nozzle plate 20 provided on the opposite side surface of the communication plate 15 to the flow path formation substrate 10.

The communication plate 15 is provided with nozzle communication paths 16 that provide communication between the pressure generation chambers 12 and the nozzle openings 21. The communication plate 15 has a larger area than the flow path formation substrate 10. The nozzle plate 20 has a smaller area than the flow path formation substrate 10. Because the communication plate 15 is provided in this manner, the nozzle openings 21 of the nozzle plate 20 and the pressure generation chambers 12 can be disposed apart from each other so that the ink in the pressure generation chambers 12 is less easily affected by the viscosity increase or thickening of the ink caused by evaporation of moisture that occurs in the ink near the nozzle openings 21. Furthermore, the nozzle plate 20 needs only to cover the openings of the nozzle communication paths 16 that provides communication between the pressure generation chambers 12 and the nozzle openings 21. Therefore, the area of the nozzle plate 20 can be made relatively small, so that the cost can be reduced.

Furthermore, the communication plate 15 is provided with first manifold portions 17 and second manifold portions 18 (constricted flow paths or orifice flow paths) which form parts of manifolds 100.

The first manifold portions 17 penetrate through the communication plate 15 in its thickness direction (the stacking direction of the communication plate 15 and the flow path formation substrate 10 (third direction Z)). The second manifold portions 18 do not penetrate through the communication plate 15 in its thickness direction but each have an opening in a nozzle plate 20-side surface of the communication plate 15.

The communication plate 15 is also provided with supply communication paths 19 that each communicate with a second direction Y-side end portion of a pressure generation chamber 12. The supply communication paths 19 are provided independently for each of the pressure generation chambers 12. The supply communication paths 19 provide communication between the second manifold portions 18 and the pressure generation chambers 12.

The communication plate 15 described above may be made of a metal, such as stainless steel or nickel (Ni), or a ceramic such as zirconium (Zr). It is preferable that the communication plate 15 be made of a material whose linear expansion coefficient is comparable or substantially equal to that of the flow path formation substrate 10. That is, if the communication plate 15 is made of a material whose linear expansion coefficient is greatly different from that of the flow path formation substrate 10, heating or cooling will cause warpage of the flow path formation substrate 10 and the communication plate 15. In this exemplary embodiment, the communication plate 15 is made of the same material as the flow path formation substrate 10, that is, made from a silicon single crystal substrate, so that thermal warpage or thermal crack, detachment, etc. can be restrained.

The nozzle plate 20 is provided with the nozzle openings 21 that communicate with the corresponding pressure generation chambers 12 via the nozzle communication paths 16. The thus-formed nozzle openings 21 are aligned in the first direction X, forming nozzle rows 21*a*. In the nozzle plate 20, two nozzle rows 21*a* of nozzle openings 21 aligned in the first direction X are disposed side by side in the second direction Y. Of the two side surfaces of the nozzle plate 20, the surface from which ink droplets are discharged, that is, the opposite surface of the nozzle plate 20 to the pressure generation chambers 12, will be referred to as the liquid ejection surface 20*a*.

The nozzle plate 20 described above may be made of, for example, a metal such as stainless steel (e.g., a JIS SUS series stainless steel), an organic substance, such as polyimide resin, a silicon single crystal substrate, etc. Use of a silicon single crystal substrate to form the nozzle plate 20 will provide substantially equal linear expansion coefficients of the nozzle plate 20 and the communication plate 15, so that the warpage caused by heating or cooling or the crack, detachment, etc., caused by heat can be restrained.

The opposite side surface of the flow path formation substrate 10 to the communication plate 15 is provided with vibration plates 50. In this exemplary embodiment, each vibration plate 50 is made up of an elastic film 51 made of silicon oxide that is provided on the flow path formation substrate 10 side and an insulator film 52 made of zirconium oxide that is provided on the elastic film 51. Liquid flow paths, such as the pressure generation chambers 12, are formed by performing anisotropic etching on the flow path formation substrate 10 from the side of the one surface thereof (from the side of the surface to which the nozzle plate 20 is joined). Other-side surfaces of the liquid flow paths, such as the pressure generation chambers 12, are defined by the elastic films 51.

Piezoelectric actuators 130, an example of a pressure generation unit, are provided on the vibration plates 50 of the flow path formation substrate 10. Each piezoelectric actuator 130 has a first electrode 60, a piezoelectric body layer 70, and a second electrode 80. Note that a piezoelectric actuator 130 refers to a portion that includes a first electrode 60, a piezoelectric body layer 70, and a second electrode 80. Generally, one of the positive and negative electrodes of the piezoelectric actuators 130 is provided as a common electrode and the other electrode is provided separately for each of the pressure generation chambers 12 by patterning. In this exemplary embodiment, the first electrode 60 is a common electrode continuously extending for the plurality of piezoelectric actuators 130, while the second electrodes 80 are provided independently for each piezoelectric actuator 130, forming individual electrodes. Of course, this electrode arrangement may be reversed according to convenience for drive circuits or wiring. Although in the foregoing example, each of the vibration plates 50 is made up of an elastic film 51 and an insulator film 52, the invention is, of course, not limited to this construction. For example, each vibration plate 50 may include only one of an elastic film 51 and an insulator film 52. Furthermore, each vibration plate 50 may be made up of only a first electrode 60 that acts also as a vibration plate, without providing the elastic films 51 and the insulator films 52 for the vibration plates 50. Furthermore, the piezoelectric actuators 130 may be designed to substantially function also as vibration plates.

The piezoelectric body layer 70 is made of a piezoelectric material that is an oxide having a polarized structure. For example, the piezoelectric body layer 70 may be made of a perovskite-type oxide represented by a general formula $ABO_3$. A lead-based piezoelectric material that contains lead, a non-lead-based piezoelectric material that does not contain lead, etc., may be used.

Furthermore, each of the second electrodes 80, which are the individual electrodes of the piezoelectric actuators 130, is connected to an end portion of a lead electrode 90 made of, for example, gold (Au) or the like. Each lead electrode 90 is extracted from a vicinity of an end of a corresponding one of the second electrodes 80 which end is remote from a corresponding one of the supply communication paths 19, and extends onto the corresponding vibration plate 50.

Furthermore, the other end of each lead electrode 90 is connected to the wiring board 121 provided with a drive circuit 120 for driving the piezoelectric actuators 130. The wiring board 121 may be made of a sheet-shaped substrate that is flexible, for example, a chip-on-film (COF) substrate or the like.

One surface of the wiring board 121 is provided with a second terminal 122 that electrically connects to a first terminal 311 of a head substrate 300 (described below). Incidentally, the wiring board 121 does not need to be provided with the drive circuit 120. That is, the wiring board 121 is not limited to a COF substrate but may be a flat flexible cable (FFC) substrate, a flexible printed circuit (FPC) substrate, etc.

The piezoelectric actuator 130-side surface of the flow path formation substrate 10 is joined to the protective substrate 30 that has substantially the same size as the flow path formation substrate 10. The protective substrate 30 has holder portions 31 that provide spaces for protecting the piezoelectric actuators 130. Each holder portion 31 has a recess shape that does not penetrate through the protective substrate 30 in its thickness direction, that is, the third direction Z, but that has an opening on the flow path formation substrate 10 side. The holder portions 31 are provided independently for each row of piezoelectric actuators 130 aligned side by side in the first direction X.

That is, in the protective substrate 30, two holder portions 31 are aligned side by side in the second direction Y so as to house two rows of piezoelectric actuators 130 aligned side by side in the first direction X. Each of the holder portions 31 described above needs merely to have such a space that movements of the piezoelectric actuators 130 are not impeded. The spaces of the holder portions 31 may be tightly sealed or left unsealed.

The protective substrate 30 has a through hole 32 that penetrates in the thickness direction, that is, the third direction Z. The through hole 32 is provided between the two holder portions 31 aligned side by side in the second direction Y and extends in the first direction X, that is, the side-by-side alignment direction of the piezoelectric actuators 130. That is, the through hole 32 is an opening that has longer sides in the side-by-side alignment direction of the plurality of piezoelectric actuators 130. The other ends of the lead electrode 90 extend so as to be exposed in the through hole 32, in which the lead electrodes 90 and the wiring board 121 are electrically connected.

It is preferable that the protective substrate 30 described above be made of a material that has substantially the same thermal expansion coefficient as the flow path formation substrate 10, for example, glass, a ceramic material, etc. In this exemplary embodiment, the protective substrate 30 is formed by using the same silicon single crystal substrate as used for the flow path formation substrate 10. Furthermore, the method for joining the flow path formation substrate 10 and the protective substrate 30 is not particularly limited. For example, in this exemplary embodiment, the flow path formation substrate 10 and the protective substrate 30 are joined by using an adhesive (not shown).

The case member 40, in a plan view, has substantially the same shape as the communication plate 15 and is joined to protective substrate 30 and also to the communication plate 15. Concretely, the case member 40 has on its protective substrate 30 side a recess portion 41 that has such a depth as to house the flow path formation substrate 10 and the protective substrate 30. The recess portion 41 has an opening area that is larger than the surface of the protective substrate 30 which is joined to the flow path formation substrate 10. The nozzle plate 20-side opening surface of the recess portion 41, with the flow path formation substrate 10 and the like housed in the recess portion 41, is sealed by the communication plate 15. Therefore, along an outer perimeter portion of the flow path formation substrate 10, third manifold portions 42 are defined by the case member 40.

The first manifold portions 17 and the second manifold portions 18 that are formed in the communication plate 15 and the third manifold portions 42 defined partially by the case member 40 constitute the manifolds 100. That is, the manifolds 100 include the first manifold portions 17, the second manifold portions 18, and the third manifold portions 42. The manifolds 100 are disposed at both outer sides of the two rows of pressure generation chambers 12 in the second direction Y. The two manifolds 100 provided at both outer sides of the two rows of the pressure generation chambers 12 are provided independently of each other so as not to communicate with each other in the head body 2. Of course, the two manifolds 100 may be in communication with each other.

The case member 40 has introduction ports 44 that communicate with the manifolds 100. That is, the introduction ports 44 are opening portions that are inlets through which the ink supplied to the head body 2 is introduced into the manifolds 100.

Furthermore, the case member 40 has a connection opening 43 which communicates with the through hole 32 of the protective substrate 30 and through which an end portion of the wiring board 121 is inserted. An opposite end portion of the wiring board 121 extends to a side in a penetrating direction of the through hole 32 and the connection opening 43, that is, to a side in a third direction Z opposite to the direction in which ink droplets are discharged (i.e., to a negative Z side).

As for the material of the case member 40, for example, a resin, a metal, etc., may be used. Incidentally, if the case member 40 is molded from a resin material, low-cost mass production can be achieved.

The compliance substrate 45 is provided on a surface of the communication plate 15 in which the first manifold portions 17 and the second manifold portions 18 have openings. The compliance substrate 45, in a plan view, has substantially the same size as the communication plate 15 and is provided with a first opening portion 45*a* that exposes the nozzle plate 20. The compliance substrate 45, while exposing the nozzle plate 20 through the first opening portion 45*a*, seals the liquid ejection surface 20*a*-side openings of the first manifold portions 17 and the second manifold portions 18. That is, the compliance substrate 45 partially defines the manifolds 100.

The compliance substrate 45 includes a sealing film 46 and a fixture substrate 47. The sealing film 46 is made of a flexible thin film (e.g., a thin film formed from polyphenylene sulfide (PPS) or the like and having a thickness of 20 μm or less). The fixture substrate 47 is formed from a hard material such as a metal including stainless steel (e.g., a JIS SUS series stainless steel) and the like. Portions of the fixture substrate 47 which face the manifolds 100 are removed completely in the thickness direction to form second opening portions 48. Therefore, a one-surface-side portion of each manifold 100 forms a compliance portion 49 that is a flexible portion sealed only by the sealing film 46 that has flexibility. In this exemplary embodiment, the compliance portions 49 are provided corresponding one-to-one to the manifolds 100. That is, in this exemplary embodiment, since the two manifolds 100 are provided, two compliance portions 49 are provided on both sides of the nozzle plate 20 in the second direction Y.

In the head body 2 constructed as described above, when ink is ejected, ink is taken through the introduction ports 44 to fill the flow paths extending from the manifolds 100 to the nozzle openings 21. Then, according to signals from the drive circuit 120, voltage is applied to piezoelectric actuators 130 that correspond to predetermined pressure generation chambers 12, so that the piezoelectric actuators 130 undergo flexure deformation together with the adjacent vibration plates 50. Therefore, the pressure in the pressure generation chambers 12 increases so that ink droplets are ejected from the corresponding nozzle openings 21.

Figure 4:
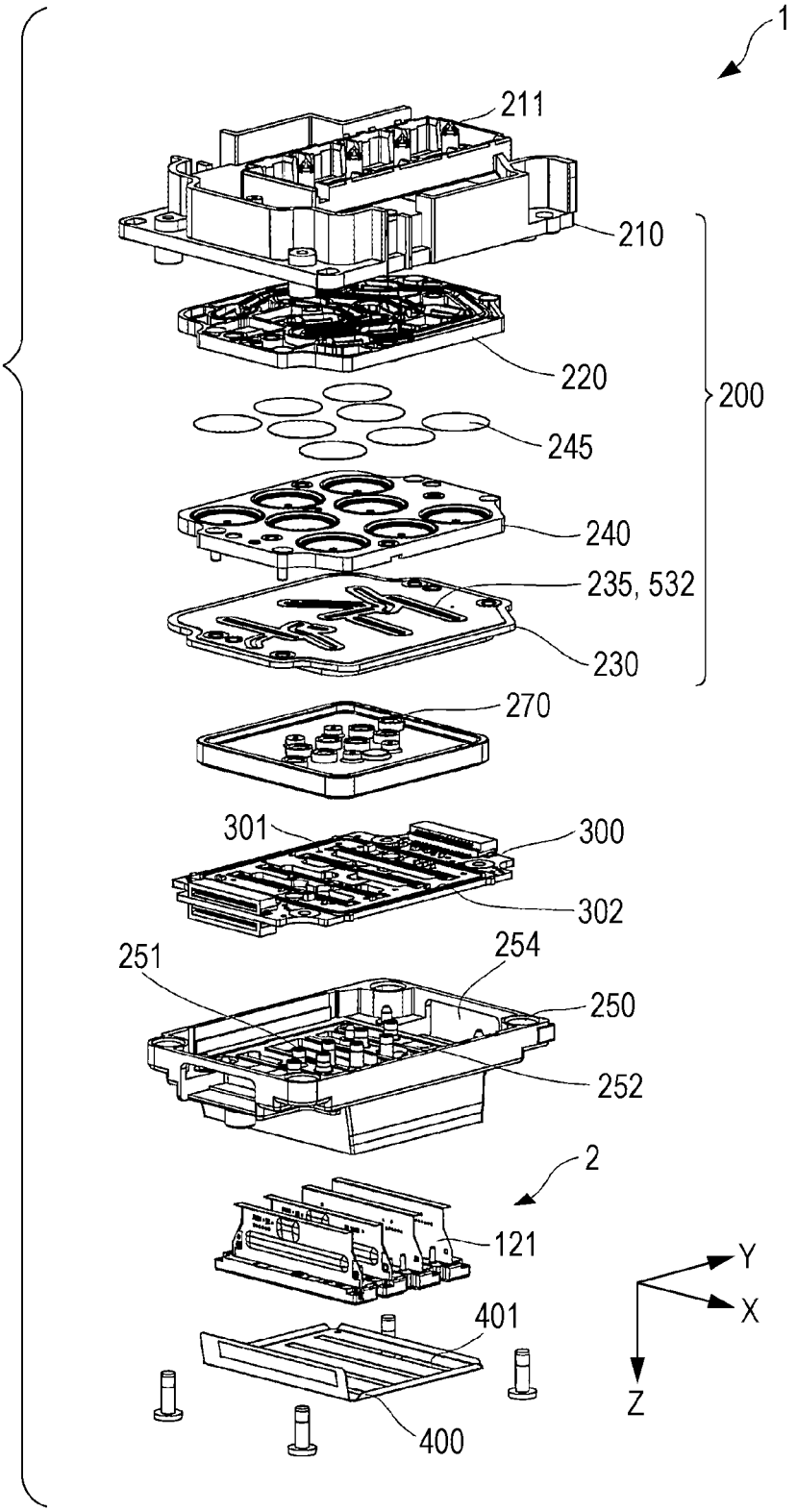
FIG. 4 is an exploded perspective view of a head.
Figure 5:
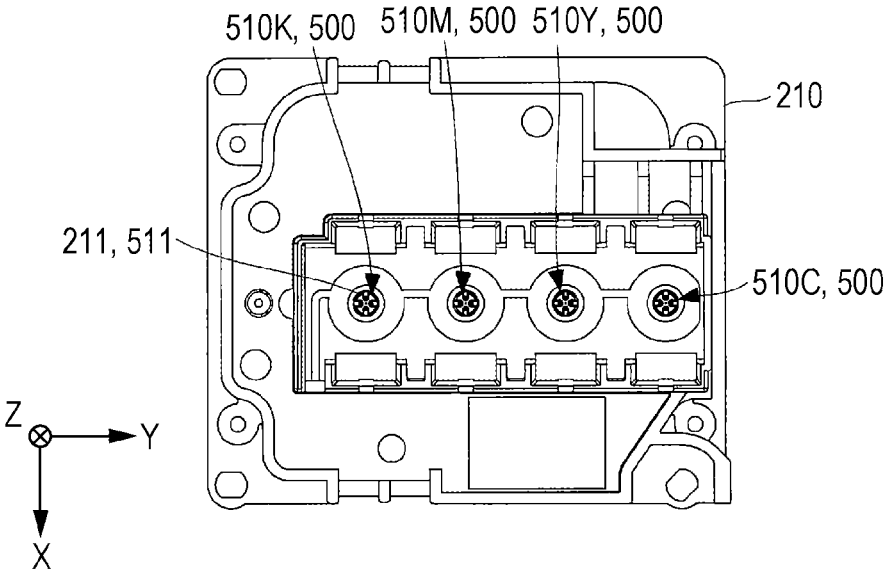
FIG. 5 is a plan view of a first flow path member.
Figure 6:
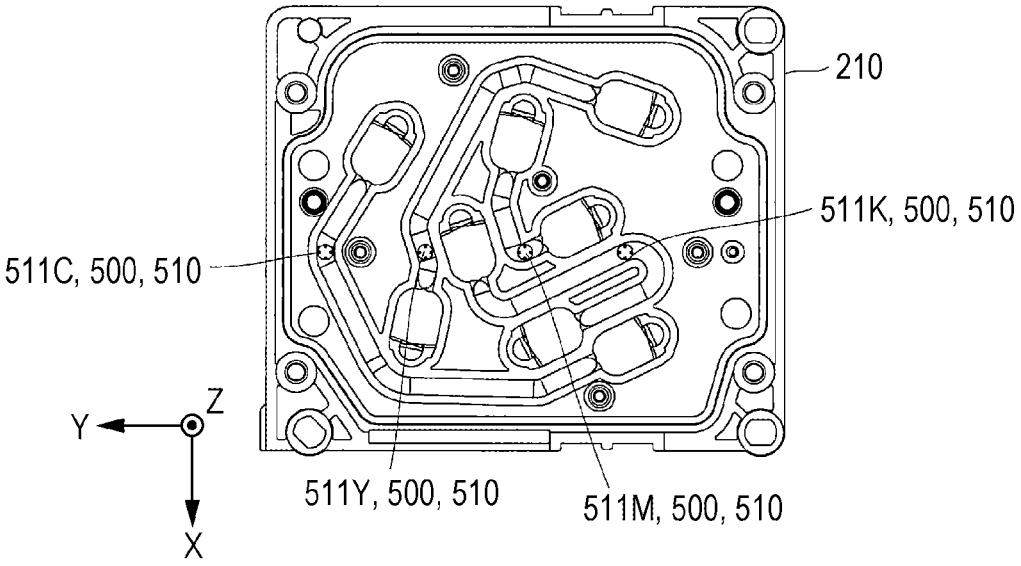
FIG. 6 is a view of the reverse surface of the first flow path member.
Figure 7:
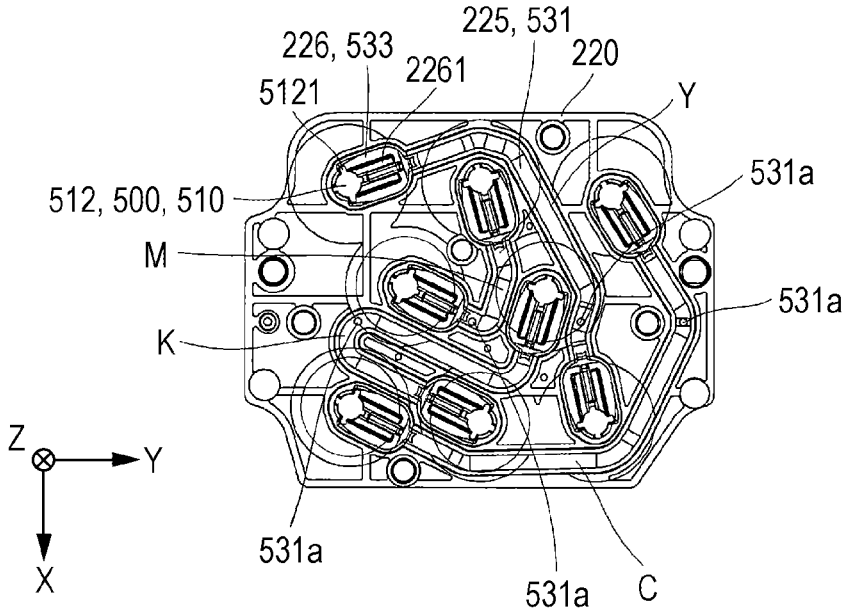
FIG. 7 is a plan view of a second flow path member.
Figure 8:
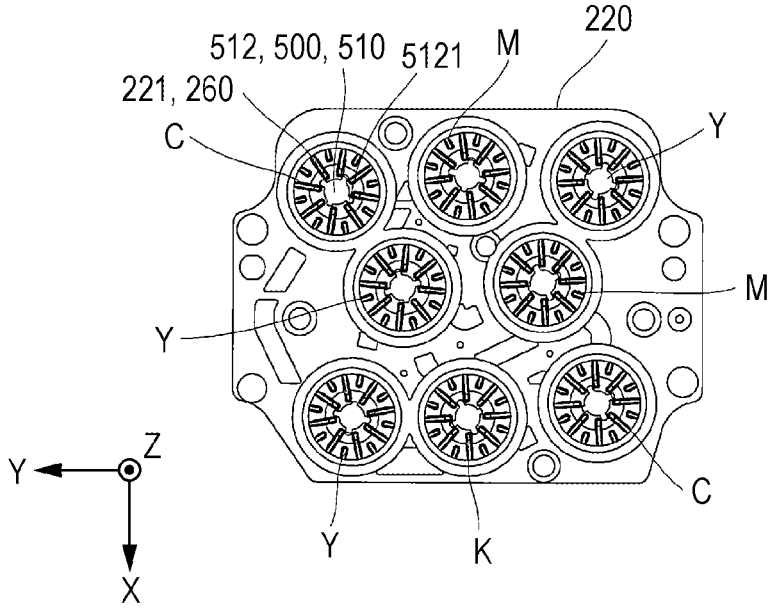
FIG. 8 is a view of the reverse surface of the second flow path member.
Figure 9:
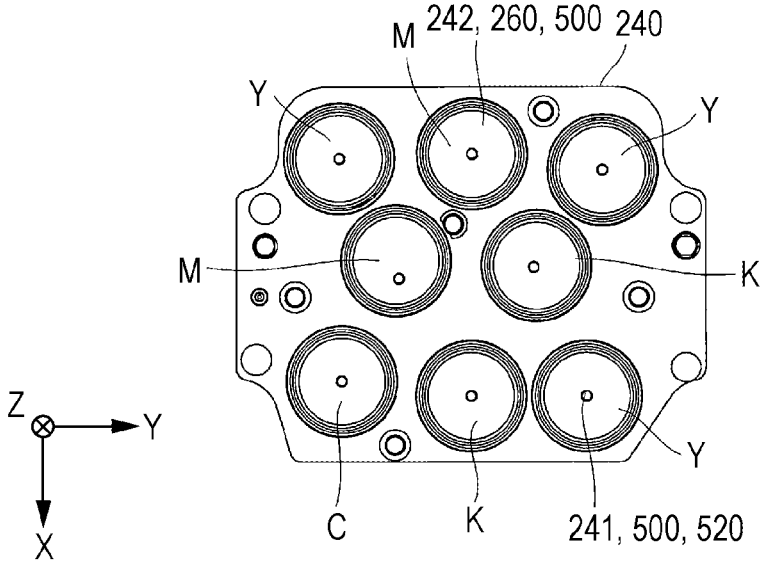
FIG. 9 is a plan view of a filter retainer member.
Figure 10:
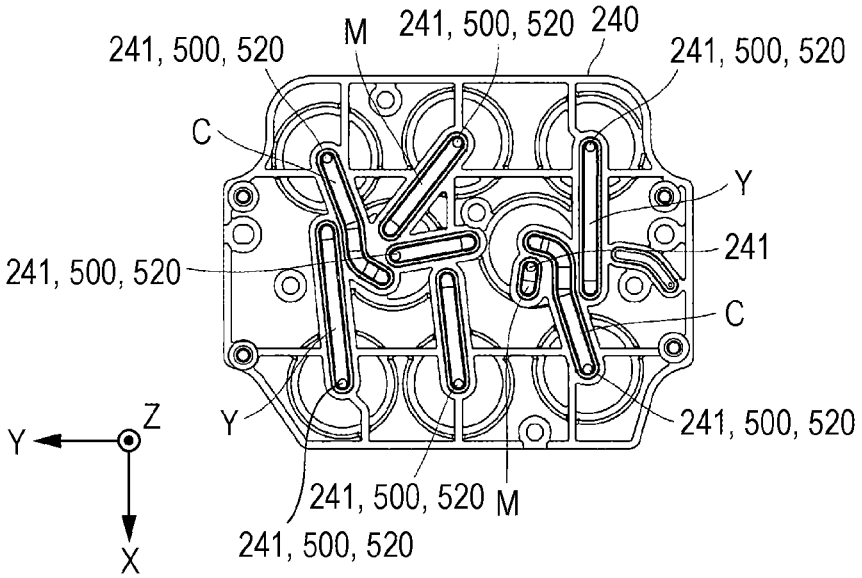
FIG. 10 is a view of a reverse surface of the filter retainer member.
Figure 11:
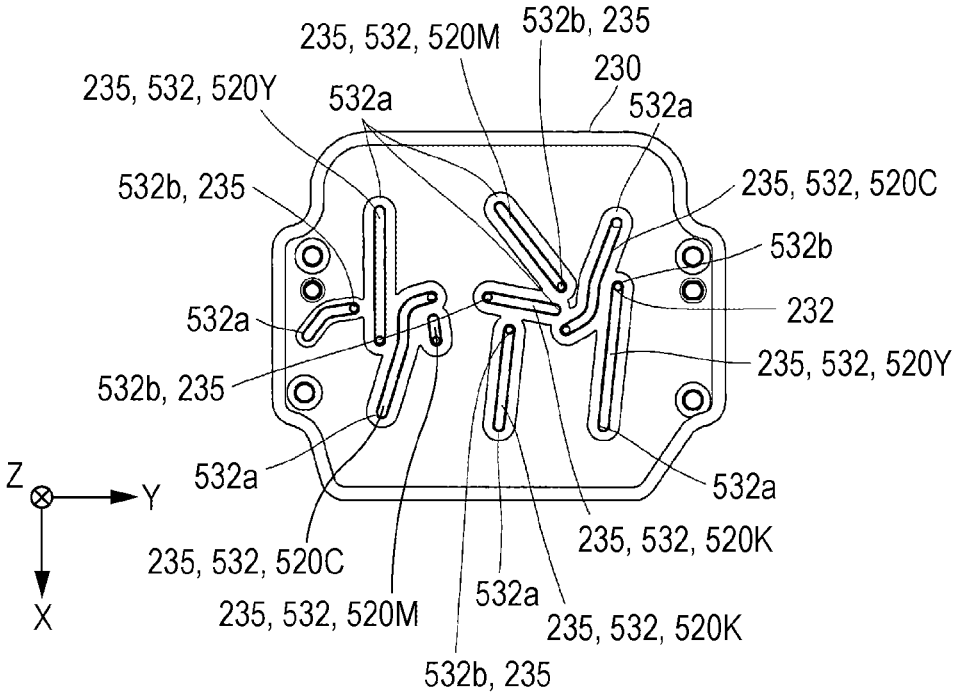
FIG. 11 is a plan view of a third flow path member.
Figure 12:
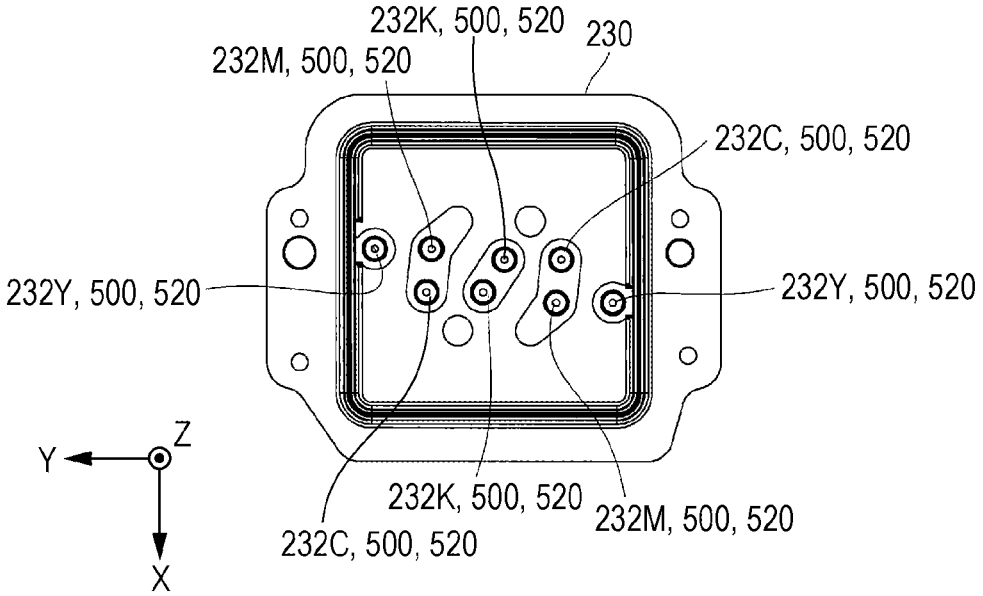
FIG. 12 is a view of the reverse surface of the third flow path member.
Figure 13:
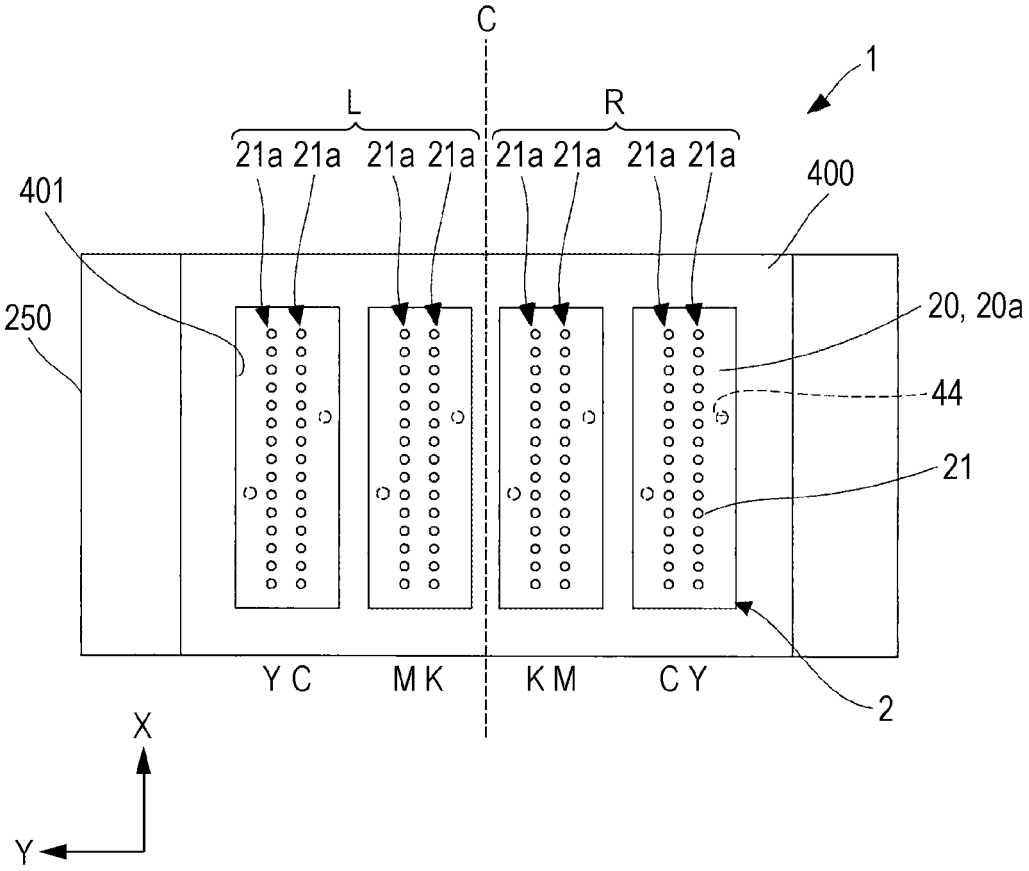
FIG. 13 is a bottom plan view of a head.

A head 1 that includes the foregoing head body 2 will be described in detail. FIG. 4 is an exploded perspective view of a head. FIG. 5 and FIG. 6 are a plan view and a view of a reverse surface, respectively, of a first flow path member. FIG. 7 and FIG. 8 are a plan view and a view of a reverse surface, respectively, of a second flow path member. FIG. 9 and FIG. 10 are a plan view and a view of a reverse surface, respectively, of a filter retainer member. FIG. 11 and FIG. 12 are a plan view and a view of a reverse surface, respectively, of a third flow path member. FIG. 13 is a bottom plan view of the head.

The head 1 in this exemplary embodiment ejects four color inks of cyan, magenta, yellow, and black as a plurality of kinds of inks. Of course, the number of the kinds of inks is not limited to four and the kinds of inks used are not limited to the foregoing color inks.

As shown in FIGS. 4 to 10, the head 1 includes four head bodies 2, a head case 250 that holds the head bodies 2, and a head substrate 300 supported on the head case 250.

A flow path member 200 has liquid flow paths 500 that supplies inks (liquids) from ink supply units, such as ink cartridges, to the head bodies 2 and also has filters 245 that are provided in the liquid flow paths 500. Concretely, the flow path member 200 includes a first flow path member 210, a second flow path member 220, a filter retainer member 240, and a third flow path member 230.

The first flow path member 210, the second flow path member 220, the filter retainer member 240, and the third flow path member 230 are integrally formed or connected by, for example, an adhesive, welding, etc. The method for stacking and fixing these members is not particularly limited. For example, screws, clamps, or the like may be used to fix these members.

The first flow path member 210 is a member that form upstream flow paths 510 that are portions of the liquid flow paths 500. Concretely, the first flow path member 210 has on its surface remote from the second flow path member 220 (i.e., its negative Z direction side surface) connection portions 211 that are connected to the liquid supply units in which the inks are held, such as ink cartridges or ink tanks. In this exemplary embodiment, the connection portions 211 are acicularly protruded. The first flow path member 210 is provided with first upstream flow paths 511 that have openings in top surfaces of the connection portions 211 and that perpendicularly penetrate through the first flow path member 210 in its thickness direction (the third direction Z).

Incidentally, the connection portions 211 may be connected directly to liquid holder portions, such as ink cartridges, or may also be connected to liquid holder portions, such as ink tanks, via supply pipes such as tubes.

The second flow path member 220 forms the upstream flow paths 510 that are portions of the liquid flow paths 500. Concretely, the first flow path member 210-side (negative third direction Z-side) surface of the second flow path member 220 is provided with first grooves 225 and recess portions 226 that each communicate with one of two end portions of one of the first grooves 225. As the second flow path member 220 is joined to the first flow path member 210, the first grooves 225 and the recess portions 226 are sealed by the first flow path member 210 to form first horizontal flow paths 531 and buffer chambers 533, respectively.

Note that each of the first upstream flow paths 511 of the first flow path member 210 is formed at such a position as to connect to an intermediate portion of a corresponding one of the first horizontal flow paths 531, so that the liquids supplied from the first upstream flow paths 511, upon entering the first horizontal flow paths 531, divide or branch toward their two opposite ends, and thus flow into the buffer chambers 533. That is, connecting portions of the first upstream flow paths 511 with the first horizontal flow paths 531 are branching portions and the first horizontal flow paths 531 are branched flow paths.

In this exemplary embodiment, because the first upstream flow paths 511 connect to intermediate portions of the first horizontal flow paths 531 and thus the paths are each branched to two opposite sides in the first horizontal flow paths 531, equal and smooth branching can be achieved and, furthermore, the degree of freedom in laying out the branch flow paths can be improved and space saving can be facilitated. For example, first horizontal flow paths 531 may each be formed to have a Y shape in order to have branch flow paths. In this case, however, flow may become stagnant at the branching portion and therefore it is difficult to achieve equal or uniform branching without equalizing pressure losses in the branch flow paths. Thus, the degree of freedom in laying out branch flow paths is restricted and space saving cannot be facilitated.

Furthermore, it is preferable that connecting regions of the first horizontal flow paths 531 to which the first upstream flow paths 511 connect be straight portions. This design achieves smooth flows downstream of the branching portions. Even in the case where, for a reason concerning layout, the first upstream flow paths 511 need to be connected to bent portions of the first horizontal flow paths 531, it is preferable that the connecting portions of the first horizontal flow paths 531 with the first upstream flow paths 511 be linear.

Furthermore, the second flow path member 220 is provided with first filter chambers 221 formed on the filter retainer member 240 side (positive Z direction side). The first filter chambers 221 are recess portions formed so that the diameter thereof increases toward the filter retainer member 240 side. The second flow path member 220 is provided with second upstream flow paths 512 that interconnect the first filter chambers 221 and the buffer chambers 533. The second upstream flow paths 512 are connected to central portions of the first filter chambers 221.

Each of the recess portions 226 that form the buffer chambers 533 has a second upstream flow path 512 at a side opposite to a side that connected to a corresponding one of the first grooves 225. Furthermore, in each recess portion 226, two wall members 2261 that divide a flow path into three paths are provided between the second upstream flow path 512 and the connecting side to the first groove 225. Therefore, liquid having flown into the buffer chambers 533 divides into three flow paths that are a flow path between the wall members 2261 and two flow paths on both outer sides of the wall members 2261, and then flows from the outer flow paths into the second upstream flow paths 512. Therefore, even if a gas bubble is trapped and grows large in the flow path between the wall members 2261 of a buffer chamber 533, choking does not occur because liquid flows from the outer flow paths on outer sides of the wall members 2261 into the second upstream flow path 512.

Furthermore, the second upstream flow paths 512 are circular in section but each have on an inner peripheral wall thereof four grooves 5121 that extend in the flowing direction (the Z direction). Even if a gas bubble in a buffer chamber 533 grows so large as to close the opening of the second upstream flow path 512, liquid flows through the grooves 5121 and choking does not occur.

The first flow path member 210 and the second flow path member 220 as described above form the upstream flow paths 510 that include the first upstream flow paths 511, the first horizontal flow paths 531, the buffer chambers 533, and the second upstream flow paths 512.

The upstream flow paths 510 are, of the liquid flow paths 500 of the flow path member 200, flow path portions extending from the connection portions 211 to which the liquids are supplied from the ink supply units, such as ink cartridges, to the filters 245 described below. Each upstream flow path 510 branches into two flow paths as the first upstream flow path 511 connects to the first horizontal flow path 531, and the two branch flow paths extend to corresponding ones of the filters 245. That is, in each liquid flow path 500, the first horizontal flow path 531 in the upstream flow path 510 upstream of the filters 245 is divided into two flow paths.

The flow path member 200 in this exemplary embodiment includes four upstream flow paths 510 corresponding to the four color inks and the four upstream flow paths 510 are supplied with the four color inks.

The filter retainer member 240 has portions of the liquid flow paths 500 and retains the filters 245 provided in the liquid flow paths 500. Concretely, second filter chambers 242 are formed on a second flow path member 220 side (negative third direction Z side) surface of the filter retainer member 240. The second filter chambers 242 are each a recess portion formed so that the diameter thereof increases toward the second flow path member 220. The filter retainer member 240 further has first downstream flow paths 241 that communicate with the second filter chambers 242 and that penetrate through the filter retainer member 240 in its thickness direction (third direction Z).

The second filter chambers 242 are formed so as to face the first filter chambers 221 of the second flow path member 220. Therefore, as the second flow path member 220 and the filter retainer member 240 are joined, the first filter chambers 221 and the second filter chambers 242 together form filter chambers 260. The filter chambers 260 are spaces that form portions of the liquid flow paths 500. The filters 245 extend across the spaces of the filter chambers 260.

The second filter chambers 242 are arranged in three rows that are disposed side by side in the first direction X and that are made up of three, two, and three chambers 242, respectively. That is, a total of eight second filter chambers 242 are provided. This manner of arrangement achieves a space-saving layout of the first horizontal flow paths 531 and the buffer chambers 533 and also achieves a space-saving layout of the second horizontal flow paths 532 described later.

The filters 245 remove gas bubbles and undesired matters from the ink. Because the filters 245 are disposed as described above, the inks supplied from the upstream flow paths 510 flow into the first downstream flow paths 241 after undesired matters and gas bubbles in the inks are trapped by the filters 245.

The third flow path member 230 form downstream flow paths 520 that are portions of the liquid flow paths 500. Concretely, a filter retainer member 240 side (negative third direction Z side) surface of the third flow path member 230 is provided with second grooves 235. As the third flow path member 230 is joined to the filter retainer member 240, the second grooves 235 are sealed by the filter retainer member 240 to form second horizontal flow paths 532.

The third flow path member 230 further has second downstream flow path 232 that communicate with the second horizontal flow paths 532 and that penetrate through the third flow path member 230 in its thickness direction (third direction Z).

The filter retainer member 240 and the third flow path member 230 as described above form the downstream flow paths 520 that include the first downstream flow paths 241, the second horizontal flow paths 532, and the second downstream flow paths 232.

The downstream flow paths 520 are, of the liquid flow paths 500 of the flow path member 200, portions extending from the filters 245 through the second downstream flow paths 232. Each of the downstream flow paths 520 does not divide midway but is a single flow path from the filter 245 through the second downstream flow path 232.

The flow path member 200 in this exemplary embodiment has eight downstream flow paths 520 as each of the four upstream flow paths 510, corresponding to the four color inks, branches into two paths connecting to corresponding two of the downstream flow paths 520. Details of the foregoing liquid flow paths 500 will be described later.

The head case 250 is a member that holds the head bodies 2. The opposite-side (positive Z-side) surface of the head case 250 to the flow path member 200 is provided with a recess-shaped housing portion 254. The housing portion 254 has such a size as to house four head bodies 2 disposed so that the nozzle rows 21*a* are aligned side by side in the second direction Y.

A flow path member 200-side (negative Z-side) surface of the head case 250 is provided with a plurality of projected portions 251. In this exemplary embodiment, the head case 250 is provided with eight projected portions 251. The eight projected portions 251 are disposed so as to face the eight downstream flow paths 520 that are branched liquid flow paths 500 provided in the flow path member 200.

Each projected portion 251 is provided with a first communication flow path 253 penetrating through the head case 250 in the third direction Z. A top surface of each projected portion 251 (a surface thereof that faces the flow path member 200) has an open of the first communication flow path 253. A housing portion 254 side end of each first communication flow path 253 communicates with a corresponding one of the introduction ports 44 of the case member 40 for the head bodies 2.

Furthermore, the head case 250 is provided with a plurality of first insertion holes 252 through which the wiring boards 121 of the head bodies 2 are inserted. Concretely, the first insertion holes 252 penetrate through the head case 250 in the third direction Z and are formed so as to communicate with the second insertion holes 302 of the head substrate 300. In this exemplary embodiment, the head case 250 is provided with four first insertion holes 252 corresponding to the wiring boards 121 provided on the four head bodies 2.

The head substrate 300 is supported on the flow path member 200-side (negative Z-side) surface of the head case 250. The head substrate 300 is a member to which the wiring boards 121 are connected and on which electric or electronic component parts, such as resistors or circuits that control the liquid ejecting operation of the head 1 and the like via the wiring boards 121.

The flow path member 200-side surface of the head substrate 300 is provided with terminals to which terminals of the wiring boards 121 are electrically connected. The head substrate 300 is further provided with a plurality of second insertion holes 302 through which the wiring boards 121 electrically connected to the head bodies 2 are inserted. Concretely, the second insertion holes 302 penetrate through the third direction Z so as to communicate with the first insertion holes 252 of the head case 250. In this exemplary embodiment, the head substrate 300 is provided with four second insertion holes 302 corresponding to the four wiring boards 121 of the four head bodies 2.

The head substrate 300 is further provided with through holes 301 that penetrate through the head substrate 300 in the third direction Z. The projected portions 251 of the head case 250 are inserted through the through holes 301. In this exemplary embodiment, the head substrate 300 is provided with a total of eight through holes 301 facing the projected portions 251.

Incidentally, the configuration of the through holes 301 that form the head substrate 300 is not limited to what is described above. For example, it suffices that the head substrate 300 is provided with insertion holes, cutouts, or the like so as not to interfere with connection of the projected portions 251 to the downstream flow paths 520.

Each of the wiring boards 121 connected to the head bodies 2 is inserted through the connection opening 43 of a corresponding one of the head bodies 2, a corresponding one of the first insertion holes 252 of the head case 250, and a corresponding one of the second insertion holes 302 of the head substrate 300 and is bent to the corresponding terminals on the head substrate 300. The terminals of the head substrate 300 are electrically connected to the terminals provided on the wiring boards 121. The manner of this connection between the terminals is not particularly limited. The electrical connection can be achieved by, for example, soldering, welding, pressure bonding with an interposed anisotropic electroconductive adhesive (anisotropic conductive paste (ACP) or anisotropic conductive film (ACF)), an interposed non-electroconductive adhesive (non-conductive paste (NCP) or non-conductive film (NCF)), etc.

A seal member 270 for preventing leakage of ink is provided between the head substrate 300 and the third flow path member 230. The seal member 270 may be made of a material (elastic material) that has liquid resistance to liquids, such as inks used in the head 1, and that is elastically deformable, for example, rubber, elastomer, etc.

Concretely, the seal member 270 is provided with second communication flow paths 271 that penetrate through the seal member 270 in the third direction Z. The seal member 270 is held between the third flow path member 230 and the projected portions 251 inserted through the through holes 301 of the head substrate 300, with the downstream flow paths 520 and the first communication flow path 253 in communication with each other via the second communication flow paths 271. In this exemplary embodiment, eight second communication flow paths 271 are formed, corresponding to the eight downstream flow paths 520, so that the eight downstream flow paths 520 communicate with the first communication flow paths 253 of the eight projected portions 251 of the head case 250.

Thus, the liquid flow paths 500 of the flow path member 200 communicate with the introduction ports 44 of the head bodies 2, via the first communication flow paths 253 of the head case 250 and the second communication flow paths 271 of the seal member 270.

A cover head 400 is a member to which the head bodies 2 are fixed and which is fixed to the head case 250. The cover head 400 is provided with opening portions 401 that expose the nozzle openings 21. In this exemplary embodiment, the opening portions 401 have such a size as to expose the nozzle plates 20, that is, have substantially the same size and shape as the first opening portions 45*a* of the compliance substrates 45.

The cover head 400 is joined to the opposite side (positive Z side) of each compliance substrate 45 to the communication plates 15 and seals a space on the opposite side of the compliance portions 49 to the manifolds 100. Because the compliance portions 49 are covered with the cover head 400 in this manner, the compliance portions 49 can be restrained from being broken if a recording medium, such as paper, contacts the compliance portions 49. Furthermore, the cover head 400 restrains ink from adhering to the compliance portions 49, and ink adhering to the surface of the cover head 400 can be removed by, for example, a wiper blade or the like, so that the recording medium can be restrained from being stained by ink that adheres to the cover head 400, or the like. Although not particularly graphically shown in the drawings, the space between the cover head 400 and the compliance portions 49 is open to the atmosphere. Furthermore, the cover heads 400 may also be provided independently for each of the head bodies 2.

The head 1 is formed by stacking the head case 250 on which the head bodies 2 are held, the head substrate 300, the seal member 270, and the flow path member 200 as described above. In the head 1 constructed as described above, when the inks are to be ejected, the inks supplied from the connection portions 211 are supplied to the head bodies 2 via the liquid flow paths 500. Then, control signals from an external apparatus are sent to the head substrate 300, so that, according to the control signals, the head bodies 2 eject the inks.

The liquid flow paths 500 of the head 1 will now be described in detail. First, as shown in FIG. 13, each head body 2 has two nozzle rows 21*a* and four head bodies 2 are fixed to the head case 250 and the cover head 400 so that the nozzle rows 21*a* extending in the first direction X are arranged side by side in the second direction Y.

In this exemplary embodiment, four color inks are used and the nozzle rows 21*a* that discharge the same color inks are disposed symmetrically about a reference line C that extends in the first direction X. Hereinafter, this arrangement of the nozzle rows 21*a* will be referred to as the symmetrical arrangement.

The symmetrical arrangement of the nozzle rows 21*a* refers to an arrangement in which the positional order of the kinds of the inks that are discharged from the nozzle rows 21*a* on one side (e.g., a positive Y side) of the reference line C is opposite to the positional order of the kinds of the inks that are discharged from the nozzle rows 21*a* on the other side (e.g., the negative Y side) of the reference line C.

The four nozzle rows 21*a* disposed on the positive Y side of the reference line C will be referred to as the nozzle group L and the four nozzle rows 21*a* disposed on the negative Y side of the reference line C will be referred to as the nozzle group R. In this exemplary embodiment, the positional order of the kinds of the inks discharged from the nozzle rows 21*a* that constitute the nozzle group L is black (K), magenta (M), cyan (C), and yellow (Y) from the negative Y side to the positive Y side. The positional order of the kinds of the inks discharged from the nozzle rows 21*a* that constitute the nozzle group R is yellow (Y), cyan (C), magenta (M), and black (K) from the negative Y side to the positive Y side.

As for the manner in which the nozzle rows 21*a* that discharge the same color inks are arranged symmetrically about the reference line C, it suffices that the positional order of the kinds of inks discharged from the nozzle rows 21*a* is symmetrical about the reference line C as stated above. Therefore, it is not necessary that the nozzle rows 21*a* that discharge the same color inks be disposed equidistantly from the reference line C.

Although in this exemplary embodiment, two nozzle rows 21*a* are provided in each head body 2, the relation between the head bodies 2 and nozzle rows 21*a* is not limited to this arrangement. For example, all the nozzle rows 21*a* may be provided in one head body 2 or each head body 2 may be provided with one nozzle row 21*a*.

The liquid flow paths 500 that supply the inks to the head bodies 2 that have nozzle rows 21*a* that are arranged as described above will be described in detail.

First, the first horizontal flow paths 531 of the upstream flow paths 510 that constitute the liquid flow paths 500 will be described. As shown in FIGS. 5 to 8, four first horizontal flow paths 531 (first grooves 225) are provided corresponding to four color inks and are each divided into two branch paths. In this exemplary embodiment, the branching portion 531*a* of each of the first horizontal flow paths 531 communicates with a corresponding one of the first upstream flow paths 511. The buffer chambers 533 on the both end portions of the first horizontal flow paths 531 communicate with the second upstream flow paths 512. Note that in FIG. 5 to FIG. 8, Y, M, C, and K indicate yellow, magenta, cyan, and black as the colors of the inks that flow into the first horizontal flow paths 531.

The first upstream flow paths 511 are disposed so as to coincide, in a plan view, with the connection portions 211 that are inlets through which the inks supplied from the liquid supply units flow in. At the locations that are immediately under the second upstream flow paths 512 and that coincide with the second flow paths 512 in a plan view, the filter chambers 260 are provided. The second upstream flow paths 512 are disposed at central portions of the filter chambers 260.

The first upstream flow paths 511 and the second upstream flow paths 512 are apart from each other in the plan view in FIG. 7. The first upstream flow paths 511 and the second upstream flow paths 512 communicate with each other through the first horizontal flow paths 531. Therefore, although the first upstream flow paths 511 and the second upstream flow paths 512 are apart from each other in a plan view, the inks can be supplied from the first upstream flow paths 511 to the second upstream flow paths 512.

In other words, regardless of the locations, sizes, regions, etc. of the connection portions 211 and the filter chambers 260, appropriate formation of the first horizontal flow paths 531 and the buffer chambers 533 allows the inks to be supplied from the liquid supply units connected to the connection portions 211 into the filter chambers 260.

Next, the second horizontal flow paths 532 of the downstream flow paths 520 that constitute the liquid flow paths 500 will be described. As shown in FIGS. 11 and 12, the eight second horizontal flow paths 532 (the eight second grooves 235 of the third flow path member 230) are provided corresponding to the eight filter chambers 260 that communicate with the eight second upstream flow paths 512 corresponding to the eight buffer chambers 533 that communicate with the divided (branched) first horizontal flow paths 531. In this exemplary embodiment, first end portions 532*a* of the second horizontal flow paths 532 (one end portion of each second horizontal flow path 532) communicate with the first downstream flow paths 241 and second end portions 532*b* of the second horizontal flow paths 532 (other end portions thereof) communicate with the second downstream flow paths 232. Incidentally, Y, M, C, and K in FIG. 6 indicate yellow, magenta, cyan, and black as the colors of the inks that flow into the filter chambers 260. Similarly, Y, M, C, and K in FIG. 11 indicate the colors of the inks that flow into the second horizontal flow paths 532.

The first downstream flow paths 241 are disposed so as to coincide with the filter chambers 260 in a plan view. On the other hand, the second downstream flow paths 232 are disposed so as to coincide, in a plan view, with the introduction ports 44 of the head bodies 2 to which the inks are supplied. It is preferable that each first downstream flow path 241 be disposed as near to a central portion of a corresponding one of the filter chambers 260 as possible. In this exemplary embodiment, of the eight filter chambers 260, seven filter chambers 260 have at the centers thereof openings of the second downstream flow paths 232 and the other one filter chamber 260 has an opening of the second downstream flow path 232 at a location slightly apart from the center thereof, for convenience in layout.

The first downstream flow paths 241 and the second downstream flow paths 232 are disposed apart from each other in a plan view. The first downstream flow paths 241 and the second downstream flow paths 232 communicate with each other through the second horizontal flow paths 532. Therefore, although the first downstream flow paths 241 and the second downstream flow paths 232 are apart from each other in a plan view, inks can be supplied from the first downstream flow paths 241 to the second downstream flow paths 232.

That is, regardless of the locations, sizes, ranges, or the like of the filter chambers 260 and the introduction ports 44 of the head bodies 2, formation of the second horizontal flow paths 532 can allow inks to be supplied from the filter chambers 260 to the introduction ports 44 of the head bodies 2.

Because the first horizontal flow paths 531, which are upstream of the filters 245, are divided (branched) flow paths, the inks can be guided in an XY plane to locations (introduction ports 44) that correspond to the nozzle rows 21*a*. Therefore, the second horizontal flow paths 532, which are downstream of the filters 245, can be made short, so that the downstream flow paths 520, which are downstream of the filters 245 and which require strict management of gas bubbles, can be made short.

If gas bubbles occur in the upstream flow paths 510 upstream of the filters 245, the gas bubbles will be trapped by the filters 245. Therefore, in the upstream flow paths 510, strict management of gas bubbles is relatively unnecessary. In the downstream flow paths 520 downstream of the filters 245, on the other hand, if there occur gas bubbles, for example, passing through the filters 245 or the like, there is risk that the bubbles may be directly supplied to the head bodies 2; therefore, strict management of gas bubbles is needed. As a countermeasure to such gas bubbles, the head 1 performs, in order to remove gas bubbles remaining in the downstream flow paths 520, a cleaning operation in which the inks are sucked from the head bodies 2 periodically or at an arbitrary time to discharge gas bubbles present in the downstream flow paths 520 from the nozzle openings 21 together with the inks.

In the head 1 according to this exemplary embodiment, because in the downstream flow paths 520 that requires strict management of gas bubbles, the second horizontal flow paths 532 are made short, it is possible to reduce the amount of time needed for the cleaning operation and reduce the amount of ink discharged for the cleaning operation.

Furthermore, in this exemplary embodiment, the first upstream flow paths 511, which are vertical flow paths, communicate with intermediate portions of the first horizontal flow paths 531, so that each first horizontal flow path 531 is divided into two opposite branch flow paths. Therefore, path dividing (branching) can be equally and smoothly accomplished. Furthermore, the degree of freedom in laying out branched flow paths can be increased and space saving can be achieved. Furthermore, although the buffer chambers 533 are provided at the ends of the first horizontal flow paths 531, the first horizontal flow paths 531 are given certain degrees of freedom in the arrangement thereof, the degree of bend thereof, and the lengths thereof to the buffer chambers 533. It has been confirmed that even if the branch flow paths vary in the foregoing factors, for example, even if the two opposite branch paths are different in the degree of bend or in the length to the buffer chambers 533, uniform branching can be accomplished. In this exemplary embodiment, the first horizontal flow paths 531 for the yellow, magenta, cyan, and black inks vary in length, the degree of bend, etc. It has been confirmed that even if the degrees of bend of the first horizontal flow paths 531 and the lengths of the portions thereof that extend from the branching portions 531*a* to the buffer chambers 533 vary, a state of uniform branching is achieved. For example, although the first horizontal flow path 531 for the black ink is bent to have a U shape, this bend does not cause a particular problem.

Furthermore, it is preferable that connecting portions of the first horizontal flow paths 531 with the first upstream flow paths 511 be linear portions. This will smooth the flows downstream of the branching points. Even in the case where, for the sake of convenience in arrangement, a first upstream flow path 511 has to be connected to a region in a first horizontal flow path 531 in which the first horizontal flow path 531 is bent, it is preferable that at least a connecting portion of the first horizontal flow path 531 with the first upstream flow path 511 be straight.

Furthermore, the downstream flow paths 520 downstream of the filters 245 do not branch but simply supply the inks to the head bodies 2. Therefore, the lengths of the downstream flow paths 520 can be made equal, so that variations in the pressure loss can be restrained and therefore the pressures of the inks supplied to the nozzle rows 21*a* can be made equal. Due to this, variations in ink pressure among the nozzle rows 21*a* can be restrained and high-quality ejection of inks can be achieved.

Exemplary Embodiment 2

Figure 14:
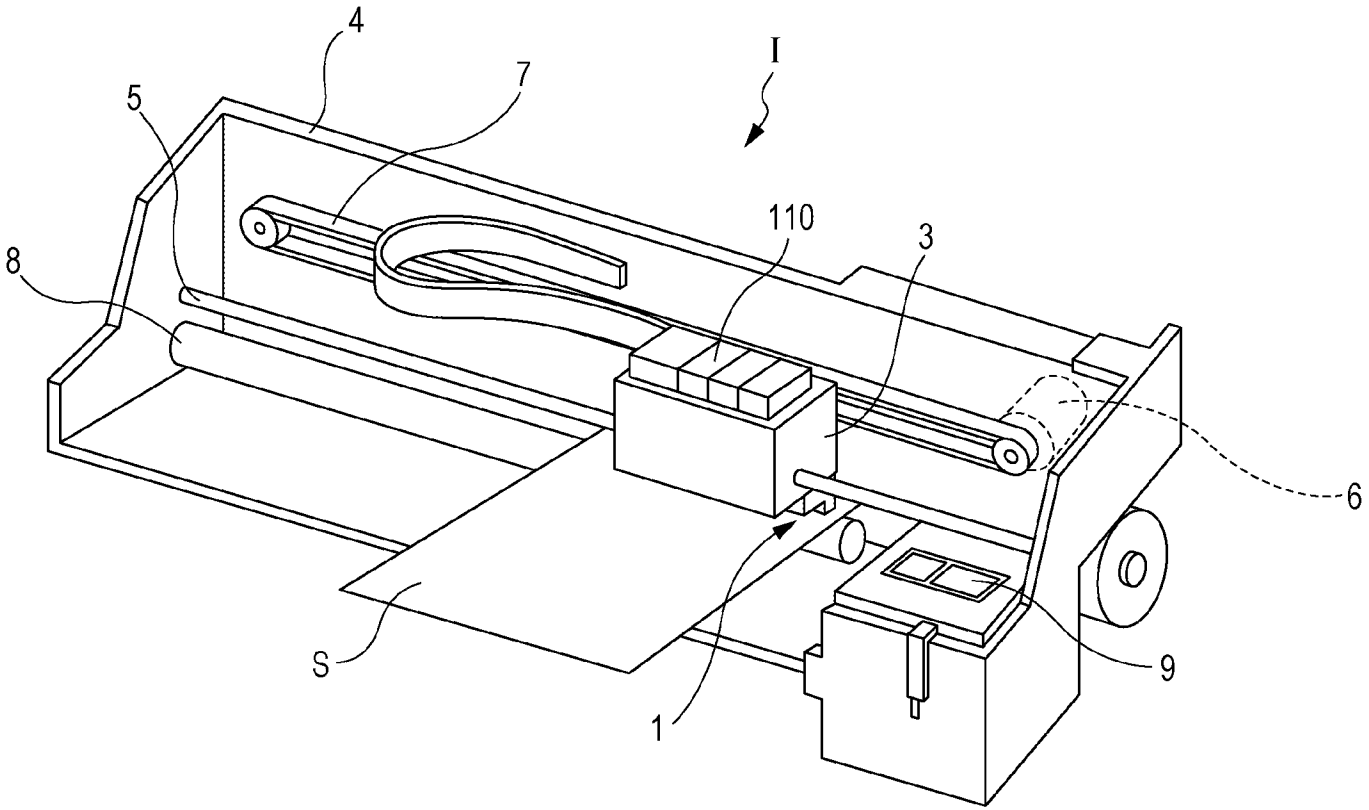
FIG. 14 is a schematic diagram illustrating an ink jet type recording apparatus.

The head 1 described above in conjunction with Exemplary Embodiment 1 is mounted in an ink jet type recording apparatus I. FIG. 14 is a schematic diagram showing an ink jet type recording apparatus as an example of a liquid ejecting apparatus.

In an ink jet type recording apparatus I shown in FIG. 14, the head 1 is provided with detachably attached ink cartridges 110, which are a liquid supply unit. A carriage 3 on which the head 1 is mounted is provided on a carriage shaft 5 attached to the apparatus main body 4. The carriage 3 is movable along an axis direction of the carriage shaft 5.

As drive force from a driving motor 6 is transmitted to the carriage 3 via a plurality of gears (not graphically shown) and a timing belt 7 so that the carriage 3 on which the head 1 is mounted moves along the carriage shaft 5. On the other hand, the apparatus main body 4 is provided with a transport roller 8 as a transport unit, so that a recording sheet S that is a recording medium, such as paper, is transported by the transport roller 8. Incidentally, the transport unit that transports the recording sheet S is not limited to the transport roller but may also be a belt, a drum, etc.

Furthermore, one side portion of the apparatus main body 4 in the moving direction of the carriage 3 is provided with a suction unit 9 that contacts the liquid ejection surface 20*a* of the head 1 and that sucks gas bubbles or undesired matters from the nozzle openings 21 together with ink. Using this suction unit 9, a cleaning operation of sucking inks from the vicinity of the nozzle openings 21 of the head 1, an initial filling that initially fills the head 1 with the inks, etc. are carried out.

Although the foregoing ink jet type recording apparatus I is an example of the liquid ejecting apparatus of the invention in which the head 1 is mounted on the carriage 3 and is thereby moved in the main scanning direction, the invention is not limited to this construction. The invention is also applicable to, for example, a so-called line type recording apparatus that includes a stationary head 1 and that only moves a recording sheet S, such as paper, in the subsidiary scanning direction to perform printing.

Furthermore, although in the foregoing example, the ink jet type recording apparatus I has a construction in which the ink cartridges 110, which are a liquid supply unit, are mounted on the carriage 3, this does not limit the invention. For example, a liquid supply unit, such as ink tanks, may be fixed to the apparatus main body 4 and the liquid supply unit and the head 1 may be interconnected via supply pipes such as tubes. Furthermore, the liquid supply unit does not necessarily need to be mounted in an ink jet type recording apparatus.

Other Exemplary Embodiments

While exemplary embodiments of the invention have been described above, a basic construction of the invention is not limited to what have described above.

For example, although the head 1 according to Exemplary Embodiment 1 includes the head case 250 that retains the head bodies 2 and the flow path member 200 that supplies the inks to the head bodies 2 through the head case 250 and the seal member 270, this construction does not limit the invention. For example, a structure in which the head bodies 2 are retained on the flow path member 200 and the inks are supplied from the flow path member 200 directly to the head bodies 2 may be adopted.

Furthermore, although the first upstream flow paths 511, the second upstream flow paths 512, the first downstream flow paths 241, and the second downstream flow paths 232, which constitute the liquid flow paths 500, are formed along the third direction Z orthogonal to the liquid ejection surfaces 20*a*, this manner of arrangement does not limit the invention. It suffices that these flow paths have components in the third direction Z; for example, the flow paths may be oblique to the third direction Z.

Although in the foregoing description, pressure generation units that cause pressure changes in the pressure generation chambers 12 are the thin film-type piezoelectric actuators 130, this arrangement does not limit the invention. For example, it is possible to use thick film-type piezoelectric actuators formed by, for example, a method in which a green sheet is stuck, longitudinal vibration-type piezoelectric actuators that are formed by alternately stacking piezoelectric materials and electrode formation materials and that are expanded and contracted in their axis directions, etc. Furthermore, the pressure generation unit may be a pressure generation unit in which a heating element is disposed in a pressure generation chamber and the heating element is caused to produce heat that generates a gas bubble whereby a liquid droplet is discharged from a nozzle opening, a so-called electrostatic actuator in which static electricity is generated between a vibration plate and an electrode and, by electrostatic force, the vibration plate is deformed to discharge a liquid droplet from a nozzle opening.

Furthermore, the invention has been made broadly for liquid ejecting heads in general and is applicable to, for example, various recording heads, such as ink jet type recording heads, for use in image recording apparatuses, such as printers, color material ejecting heads for use in producing color filters for liquid crystal displays and the like, electrode material ejecting heads for use in forming electrodes for organic electroluminescent (EL) displays, field emission displays (FEDs), etc., bioorganic material ejecting heads for use in producing biochips, etc.

The entire disclosure of Japanese Patent Application No. 2016-065749, filed Mar. 29, 2016 is expressly incorporated by reference herein.

What is claimed is:

1. A head capable of recording comprising:

a head body that has nozzle rows in which nozzle openings that eject liquid are disposed side by side in a first direction and which are disposed side by side in a second direction that intersects the first direction;

a liquid flow path that supplies the liquid from a liquid supply unit to the head body; and a flow path member that includes filters provided in the liquid flow path, wherein the nozzle rows that discharge the same liquid are disposed at locations symmetrical about a reference line that extends in the first direction, and wherein the flow path member includes a first flow path member to which the liquid from the liquid supply unit is supplied, a second flow path member joined to the first flow path member, a filter retainer member that is joined to the second flow path member and that holds the filters, a third flow path member that is joined to the filter retainer member and that supplies the liquid to the head body, and wherein the liquid flow path includes an upstream flow path upstream of the filters and downstream flow paths that are downstream of the filters and that are formed separately for each nozzle row, and wherein the upstream flow path includes horizontal flow paths that are provided between the first flow path member and the second flow path member and that divide the liquid supplied from the liquid supply unit and buffer chambers provided on the horizontal flow paths branched so as to divide the liquid, and wherein, between the second flow path member and the filter retainer member, filter chambers are provided in regions that face the buffer chambers, and wherein the buffer chambers communicate with central portions of the filter chambers.

2. The head according to claim 1, wherein each of the horizontal flow paths is a single flow path whose two end portions are provided with the buffer chambers and an intermediate portion of the flow path communicates with a flow path extending from the liquid supply unit so as to be a branching portion at which the flow path branches into two horizontal opposite directions.

3. The head according to claim 2, wherein the branching portion is immediately under the liquid supply unit.

4. A liquid ejecting apparatus comprising the head according to claim 3.

5. The head according to claim 2, wherein the branching portion is provided in a straight portion of each horizontal flow path.

6. A liquid ejecting apparatus comprising the head according to claim 5.

7. A liquid ejecting apparatus comprising the head according to claim 2.

8. A liquid ejecting apparatus comprising the head according to claim 1.

* * * * *